US010683737B2

(12) United States Patent
Martinez

(10) Patent No.: US 10,683,737 B2
(45) Date of Patent: Jun. 16, 2020

(54) RETRIEVABLE PERMANENT MAGNET PUMP

(71) Applicant: BAKER HUGHES, A GE COMPANY, LLC, Houston, TX (US)

(72) Inventor: Ignacio Martinez, Tulsa, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 173 days.

(21) Appl. No.: 15/895,373

(22) Filed: Feb. 13, 2018

(65) Prior Publication Data

US 2019/0249526 A1 Aug. 15, 2019

(51) Int. Cl.

| | |
|---|---|
| ***E21B 43/12*** | (2006.01) |
| ***F04D 1/06*** | (2006.01) |
| ***F04D 13/08*** | (2006.01) |
| ***F04C 11/00*** | (2006.01) |
| ***F04D 13/12*** | (2006.01) |
| ***F04C 15/00*** | (2006.01) |
| ***F04C 2/107*** | (2006.01) |
| *F04D 29/22* | (2006.01) |

(52) U.S. Cl.

CPC ..... *E21B 43/128* (2013.01); *F04C 2/107* (2013.01); *F04C 11/006* (2013.01); *F04C 15/008* (2013.01); *F04D 1/06* (2013.01); *F04D 13/086* (2013.01); *F04D 13/12* (2013.01); *F04D 29/22* (2013.01)

(58) Field of Classification Search

CPC ..... E21B 43/128; F04C 13/008; F04D 13/10

See application file for complete search history.

(56) References Cited

U.S. PATENT DOCUMENTS

| | | | | |
|---|---|---|---|---|
| 5,746,582 | A | 5/1998 | Patterson | |
| 5,871,051 | A | 2/1999 | Mann | |
| 5,954,483 | A | 9/1999 | Tetzlaff | |
| 5,988,992 | A | 11/1999 | Tetzlaff et al. | |
| 6,193,474 | B1 | 2/2001 | Tetzlaff | |
| 7,419,007 | B2 | 9/2008 | Belcher et al. | |
| 7,730,937 | B2 | 6/2010 | Head | |
| 2002/0050361 | A1* | 5/2002 | Shaw | E21B 43/128 166/380 |
| 2010/0108912 | A1 | 5/2010 | Sakai et al. | |

FOREIGN PATENT DOCUMENTS

WO WO 2018/022198 * 2/2018

* cited by examiner

*Primary Examiner* — Kristyn A Hall

(74) *Attorney, Agent, or Firm* — Bracewell LLP; James E. Bradley

(57) ABSTRACT

A well pumping assembly has a stator mounted in a housing, the stator having an axially extending stator cavity. The stator has windings that when powered create an electromagnetic field into the stator cavity. A pump has a landed position within the stator cavity. The pump having a non-rotating pump portion and a rotating pump portion. Magnets mount on the rotating pump portion and impart rotation to the rotating pump portion in response to the electromagnetic field. A neck on a downstream end of the pump has a running and retrieval feature for engagement by a running and retrieving tool to retrieve the pump from and install the pump in the landed position.

19 Claims, 4 Drawing Sheets

RETRIEVABLE PERMANENT MAGNET PUMP

FIELD OF INVENTION

The present disclosure relates to downhole pumping systems for well bore fluids. More specifically, the present disclosure relates to a combined pump and motor having a retrievable pump that lands within the bore of a motor stator. The pump has a rotating portion with permanent magnets driving the pump in response to electromagnetic fields emanating from the stator.

BACKGROUND

Electrical submersible pumps are commonly used in hydrocarbon producing wells. A typical pump assembly includes an electrical motor having a rotating drive shaft that drives the pump. The pump is often a centrifugal pump having a large number of stages. Each stage has a nonrotating diffuser and a rotating impeller. The motor has a drive shaft that couples to the pump shaft to rotate the impellers. The motor may have lengths up to 30 feet or more. Radial motor bearings support the motor shaft along the lengths. A dielectric fluid in the motor lubricates the motor bearings. A pressure equalizer mounts to the motor to reduce a pressure difference between the dielectric lubricant in the motor and the well fluid on the exterior. A shaft seal, usually at an end of the pressure equalizer, seals around the drive shaft to prevent the entry of well fluids into the motor lubricant.

Another type of pump assembly comprises a progressive cavity pump, which has a helical rotor that rotates within a double helical passage of an elastomeric member, also called a stator. An electrical motor may be coupled to the rotor via a gear box and flex shaft, which accommodates orbital motion of the rotor.

In one type of installation, the assembled pump and motor are attached to a lower end of a string of production tubing and lowered into casing of the well. A power cable extends alongside the production tubing to the motor to supply power. If repair or replacement to the pump is required, normally a workover rig is required to pull the tubing and the pump and motor assembly.

In another type of installation, the motor is secured to the lower end of production tubing. The pump may be lowered and retrieved through the production tubing. The pump has an engaging member on its lower end that engages the upper end of the drive shaft of the motor.

SUMMARY

A well pumping assembly comprises a housing having a longitudinal axis. A stator is mounted in the housing. The stator has an axially extending stator cavity and windings that when powered create an electromagnetic field into the stator cavity. A pump has a landed position within the stator cavity. The pump has a non-rotating pump portion and a rotating pump portion. Magnets mounted on the rotating pump portion impart rotation to the rotating pump portion in response to the electromagnetic field. A neck on a downstream end of the pump has a running and retrieval feature for engagement by a running and retrieving tool to retrieve the pump from and install the pump in the landed position.

The pump may comprise a centrifugal pump. The pump may also comprise a progressing cavity pump. The stator will accept the pump when the pump is a centrifugal pump and also when the pump is a progressing cavity pump.

A support member mounted in the upstream end of the housing has a receptacle. An anchor secured to and protruding from an upstream end of the pump is received within the receptacle when the pump is in the landed position. Mating torque surfaces between the anchor and the receptacle prevent rotation of the anchor relative to the receptacle.

A head secured to the downstream end of the housing has a bore in axial alignment with the stator cavity. The neck extends sealingly through the bore while the pump is in the landed position. The running and retrieval feature is downstream of the bore while the pump is in the landed position.

In one embodiment, the non-rotating portion of the pump comprises a stack of diffusers. The rotating portion of the pump comprises an impeller rotatably mounted between each of the diffusers. Each of the magnets is mounted to one of the impellers.

In another embodiment, the rotating portion of the pump comprises a tube having a progressing cavity passage. The non-rotating portion of the pump comprises a rotor within the progressing cavity passage and having a progressing cavity exterior.

If the pump is a centrifugal type, an intake passage may extend through the support member and the anchor to the stack of diffusers. If the pump is a progressing cavity type, the anchor may include a flex shaft secured to and protruding from an upstream end of the rotor to the anchor member. An intake passage may extend through the anchor member to an intake chamber in the housing upstream of the stator while the pump is in the landed position.

Figure 1A:
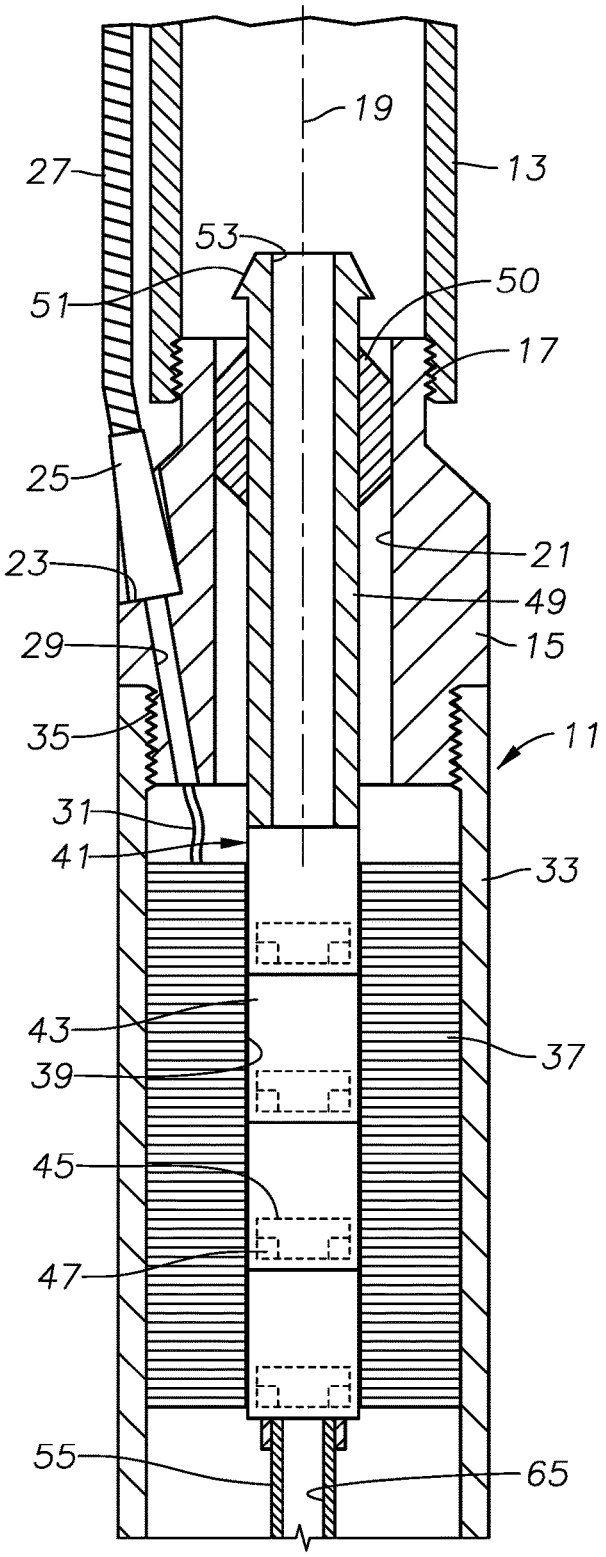
FIGS. 1A and 1B comprise a schematic sectional view of a combined pump and motor having a centrifugal pump that is retrievable from the stator of the motor in accordance with this disclosure.

While the disclosure will be described in connection with a few embodiments, it will be understood that it is not intended to limit the disclosure to these embodiments. On the contrary, it is intended to cover all alternatives, modifications, and equivalents, as may be included within the scope of the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1A schematically illustrates a string of production tubing 13 supporting a combined pump and motor. Production tubing 13 will be suspended in a cased well (not shown) during use. The combined pump and motor has a motor 11 with an adapter or head 15 having a set of upper threads 17 that secure to threads on the lower end of production tubing 13. The terms "upper", "lower" and the like are used only for convenience and not in a limiting sense as the combined pump and motor may be located within an inclined or horizontal section of a well.

Head 15 has a longitudinal axis 19 and a bore 21 that is coaxial with axis 19. Head 15 has a power cable receptacle 23 on its exterior. An electrical connector 25 at the lower end of power cable 27 secures to receptacle 23. Power cable 27 extends from a wellhead for supplying power to motor 11. In this example, power cable 27 extends alongside and is strapped to production tubing 13. Head 15 has one or more conductor passages 29 for feeding insulated conductors 31 of power cable 27 into the interior of motor 11.

A tubular housing 33 has an upper end secured to lower threads 35 on the lower or upstream end of head 15. Housing 33 contains a stator 37 made up of a stack of disks or laminations. Stator 37 is secured against rotation in housing 33. Stator 37 has windings (not shown) electrically connected to insulated conductors 31. The windings may be wound in a three-phase manner. The disks of stator 37 have aligned central openings, defining a stator cavity 39 that is coaxial with axis 19 and has a cylindrical wall or inner diameter. In this embodiment, the inner diameter of cavity 39 is equal or less than the inner diameter of head bore 21. Supplying power to the windings of stator 37 creates an electromagnetic field in stator cavity 39. Stator 37 may be in a thin container or otherwise sealed against well fluid entry into contact with the windings.

FIG. 1A shows a centrifugal pump 41 in a landed position within stator cavity 39. In this embodiment, pump 41 has a number of centrifugal pump stages, each stage having a diffuser 43 and an impeller 45. Diffusers 43 are secured and sealed to each other. In this embodiment, diffusers 43 do not rotate within stator cavity 39 and may have seals that seal the annular clearance between diffusers 43 and the inner diameter of stator cavity 39. Each impeller 45 rotates, causing well fluid to flow through impeller passages upward and outward into the intake of the adjacent downstream diffuser 43. Impellers 45 are rotationally locked to each other so that they rotate in unison. Each diffuser 43 has diffuser passages that direct the flow upward and inward to the intake of the adjacent downstream impeller 45.

Each impeller 45 has an array of permanent magnets 47 spaced circumferentially around axis 19. The electromagnetic field created by the windings in stator 37 interacts with magnets 47 to impart rotation to impellers 45. Typically, pump 41 will have many more diffusers 43 and impellers 45 than the four shown, and stator 37 will have a much greater length.

Pump 41 has an upward extending tubular neck 49 that extends through head bore 21. A seal 50, which may be a variety of types, seals the exterior of neck 49 to the inner diameter of bore 21. Neck 49 attaches to the stack of diffusers 43 and has an upper end protruding above or downstream of head 15. Neck has a discharge passage 53 for flowing well fluid pumped by pump 41 up into production tubing 13.

The upper end of neck 49 has a running and retrieving feature 51 that may be of various designs. Running and retrieving feature 51 serves to releasably connect pump 41 to a conventional running tool (not shown). Different types of running tools are available that will secure to the lower end of a running string for lowering pump 41 into the landed position within stator cavity 39. The running tool then releases pump 41, enabling the running string to be retrieved. Further, the running tool or a different retrieving tool may be subsequently lowered on the running string to latch into running and retrieving feature 51 and retrieve pump 41 from stator cavity 39. Running and retrieving feature 51 is schematically illustrated as an external flange or collar, but it could include J-slots, springs, detents and the like. The running string may comprise a cable, either electrically powered or not, or coiled tubing.

Figure 1B:
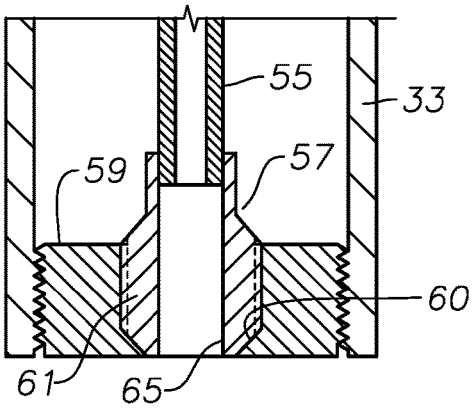

Pump 41 has an anchor on its lower end that positions pump 41 in the landed position, prevents rotation of diffusers 43, and transfers down thrust to housing 33. The anchor in this example includes an anchor shaft 55 that secures to the lowest diffuser 43 and extends downward coaxial with axis 19. As shown in FIG. 1B, the anchor also includes an anchor member 57 that attaches to the lower end of anchor shaft 55.

A support member or plate 59 secures to threads at the lower or upstream end of housing 33. Support member 59 has a receptacle 60 into which anchor member 57 lands and seals. The sealing arrangement may be metal-to-metal through conical mating surfaces, or anchor member 57 may have seal rings (not shown) that seal against a cylindrical portion of the inner wall of receptacle 60.

Anchor member 57 and receptacle 60 have mating anti-torque surfaces that serve prevent rotation of anchor member 57 relative to support member 59. As an example, the anti-torque surfaces may comprise splines 61 in receptacle 60 that engages mating splines on anchor member 57. Alternately, keys and mating slots may be employed. Anchor member 57 and receptacle 60 could also have a cooperative latch arrangement that snaps anchor member 57 in place and prevents upward movement once landed until a sufficient pull is made by a retrieving tool on running and retrieving feature 51.

Receptacle 60 may have an open lower end. In this embodiment, anchor member 57 and anchor shaft 55 have an intake passage 65 that admits well fluid to the intake of lowest impeller 45 and diffuser 43.

In the operation of the embodiment of FIGS. 1A and 1B, pump 41 may be initially installed in stator cavity 39 while at the surface and lowered into the well along with tubing 13, motor 11 and power cable 27. While at the desired depth, power supplied to stator 37 imparts rotation to impellers 45, causing well fluid to flow up intake passage 65 and out discharge passage 53 into production tubing 13. Each impeller 45 creates thrust that transfers to mating diffusers 43. Down thrust on diffusers 43 transfers through anchor shaft 55 and anchor member 57 to support member 59 and motor housing 33. If up thrust is a possibility, it could transfer through anchor member 57 to support member 59 via a latch arrangement.

If it is desired to replace pump 41, it may be retrieved from stator cavity 39 with a retrieving tool engaging running and retrieving feature 51, as described above. The operator may lower a similar or different pump 41 in place. For example, if the flow rate of well fluid flowing into the well has declined, the operator may run a pump 41 with fewer centrifugal stages or stages of a different type. Alternately, the operator could lower a different replacement pump, such as a progressing cavity pump ("PCP"), a lobe pump or a gear pump.

Figure 2A:
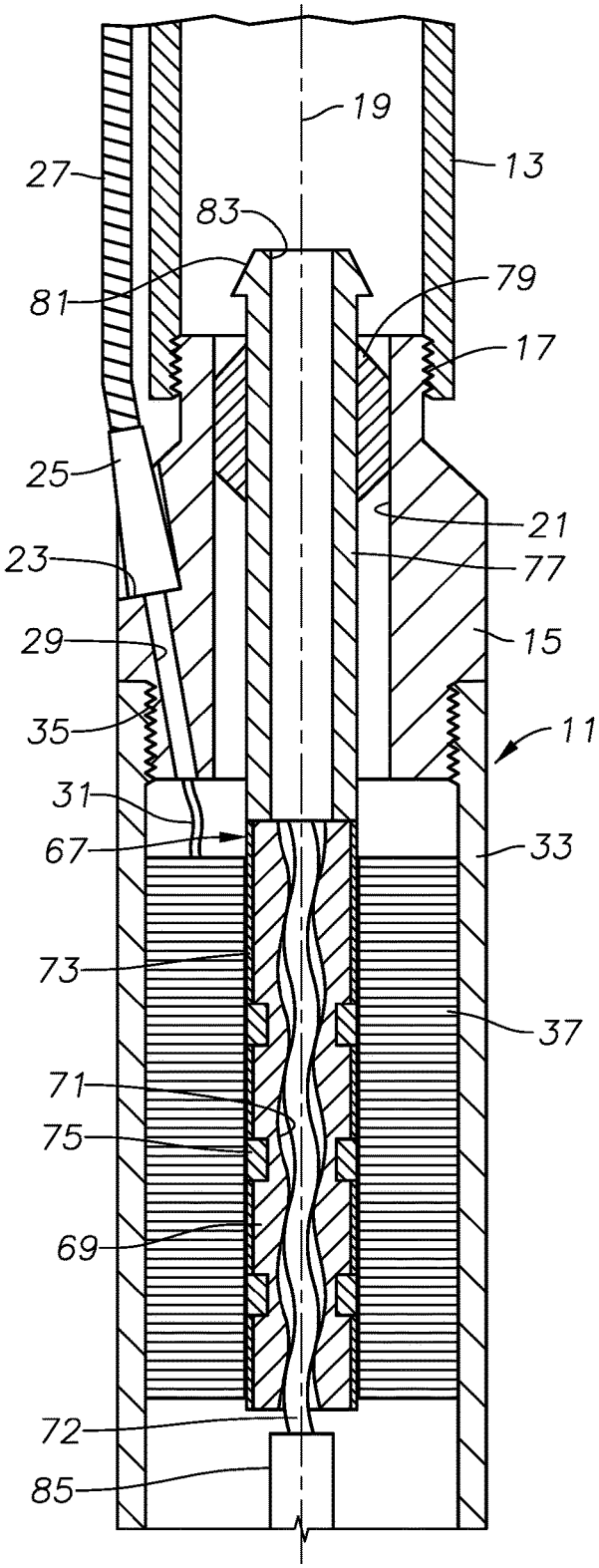
FIGS. 2A and 2B comprise a schematic sectional view of the motor of FIGS. 1A and 2B, but having a progressing cavity pump portion landed therein.
Figure 2B:
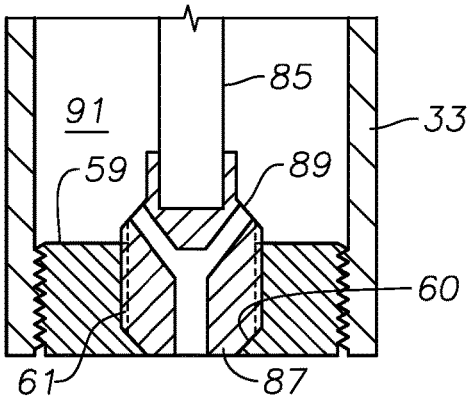

FIGS. 2A and 2B illustrate a PCP pump 67 installed within the same motor 11 that previously contained centrifugal pump 41 (FIG. 1A). PCP pump 67 could be installed initially in motor 11 instead of centrifugal pump 41. PCP pump 67 has a tube 69, which often is referred to as a stator, but tube 69 will not contain windings. Tube 69 may be formed of an elastomeric material or another material such as a metal or a composite. Tube 69 has a PCP passage 71 which has a conventional PCP contour that may be described as double helical. A rotor 72 locates within PCP passage 71. Rotor 72 has a conventional PCP contour that may be described as single helical. In this example, unlike most PCP's, rotor 72 does not rotate. Rather, tube 59 rotates relative to rotor 72, causing well fluid to flow up PCP passage 71. The exterior of tube 69 may contained with a thin shell or sleeve 73 of a non-magnetic material.

Magnets 75 cause the rotational movement of tube 69 in response to the electromagnetic field generated by stator 37. Magnets 75 are spaced apart circumferentially around tube 69 and along the length of tube 69. Magnets 75 may be secured to shell 73. Also, magnets 75 may be embedded in pockets in tube 69 and protrude through windows in shell 73. The system will likely include a surface controller that supplies power to stator 37 at a lower frequency than when centrifugal pump 41 (FIG. 1A) is installed so as to rotate tube 69 at a lower speed than the rotation of impellers 45 (FIG. 1A). Alternatively, the magnets may be arranged differently to cause tube 69 to rotate at a slower speed. If PCP pump 67 is configured for rotor 72 to rotate rather than tube 69, magnets 75 would be installed on rotor 72.

PCP 67 could be configured to be non-retrievable. If PCP pump 67 is to be retrievable, as shown, it may have an upward extending neck 77 that has a seal 79 sealing to head bore 21. Neck 77 is secured to the upper end of shell 73 and may be integral with shell 73. If tube 69 is the rotating portion of PC pump 67, seal 79 may form a dynamic sealing engagement with head bore 21. Alternatively, a sealing mechanism can be incorporated at any point between seal 79 and the top of PCP pump 67. Neck 77 has a running and retrieving feature 81 that may be identical to running and retrieving feature 51 (FIG. 1A). Neck 77 has a discharge flow passage 83 that discharges well fluid pumped by PCP pump 67 into production tubing 13.

PCP pump 67 has an anchor to land PCP pump 67 in the landed position, to prevent rotation of rotor 72 and to transfer down thrust. The anchor includes an anchor shaft 85 and an anchor member 87, as shown in FIG. 2B. Anchor member 87 lands in receptacle 60 of support member 59. Splines 61 engage mating splines on anchor member 87 to transfer torque and prevent rotation of anchor shaft 85. Anchor member 87 differs from anchor member 57 (FIG. 1B) in that it has an intake passage 89 that directs incoming well fluid to into housing 33 on the exterior of anchor shaft 85. This portion of housing 33 between support member 59 and stator 37 may be considered to be an intake chamber 91. The well fluid flows into the open lower end of PCP passage 71. Anchor shaft 85 does not need an intake passage, unlike anchor shaft 55 (FIG. 1).

Normally, a rotating rotor within a non-rotating stator of a conventional PCP pump causes orbital movement of the rotor. Absent any constraint, tube 69 would thus tend to orbit since it is rotating. In this example, tube 69 is constrained from radial movement by stator cavity 39, thus rotor 72 will orbit although it does not rotate. Anchor shaft 85 will flex and bend to accommodate the orbital motion of rotor 72, similar to a conventional flex shaft of a conventional PCP pump. Bearings (not shown) may be located between shell 67 and the inner diameter of stator cavity 39.

Figure 3:
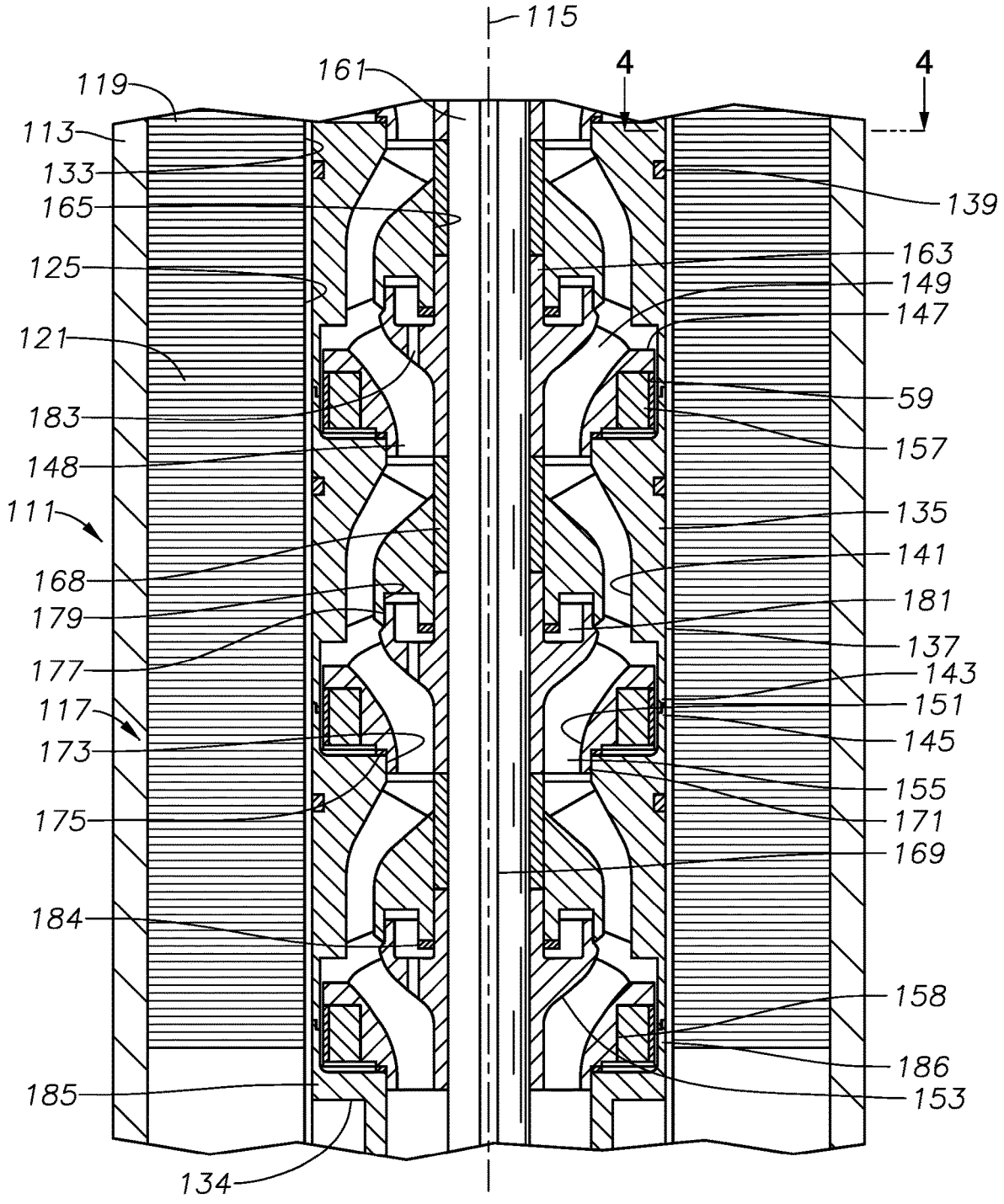
FIG. 3 is a sectional view of portions of the combined pump and motor of FIGS. 1A and 1B.
Figure 4:
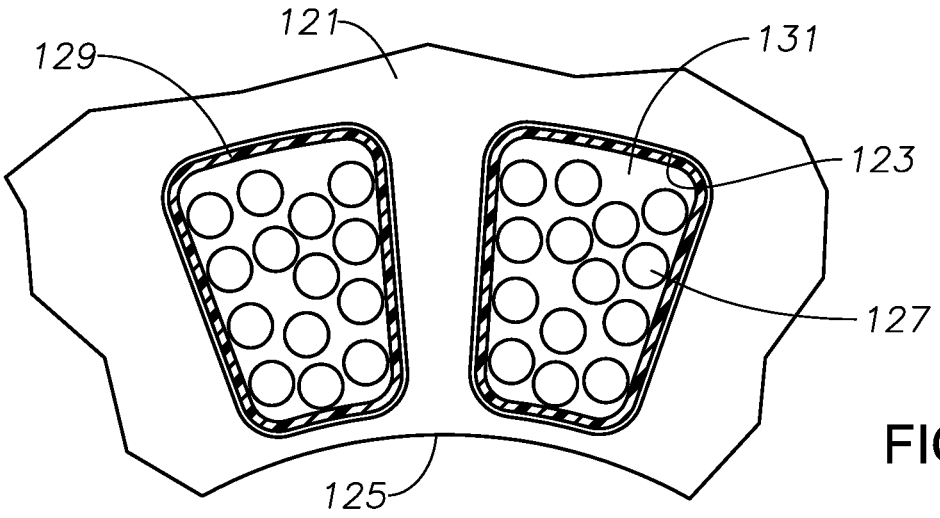
FIG. 4 is a sectional view of the stator of the motor of FIG. 3, taken along the line 4-4 of FIG. 3.
Figure 5:
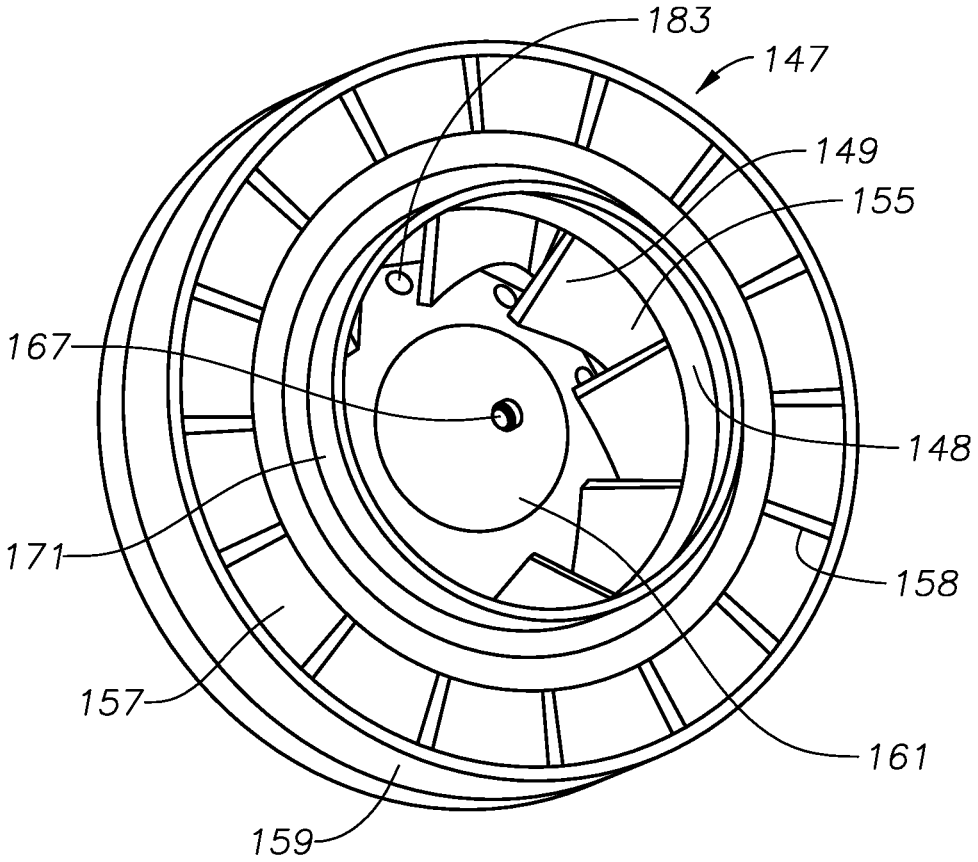
FIG. 5 is a perspective view from the intake side of one of the impellers of the pump of FIG. 3.

FIGS. 3-5 illustrate an example of the centrifugal pump stages and stator shown schematically in FIG. 1A. Pump and motor 111 has a cylindrical housing 113 with a longitudinal axis 115. A stator 117 is mounted stationarily in housing 113. In this embodiment, stator 117 closely fits within the inner diameter of housing 113. Stator 117 is made up of a large number of thin, metal discs or laminations 119, 121 stacked together. In this embodiment, discs 119, 121 include groups or sections of stator discs 119, which are made from a magnetic material such as a type of a steel alloy. The sections of stator discs 119 are separated from each other by groups or sections of spacer discs 121. Spacer discs 121 are formed of a nonmagnetic material, such as nonmagnetic stainless steel or bronze alloy. Otherwise, stator discs 119 and spacer discs 121 may be identical.

Referring to FIG. 4, a top view of a portion of one of the spacer discs 121 is illustrated; stator discs 119 are identical except for the type of material. Each disc 119, 121 has a plurality of slots 123 spaced circumferentially apart from each other around a large central aperture 125. Optionally, parts of the inner edges of slots 123 could join central aperture 125. Slots 123 of discs 119, 121 are axially aligned with each other in axial rows. Motor windings 127, which are insulated conductors, wind through the various slots 123 generally parallel with axis 115 (FIG. 3). Each row of axially aligned slots 123 may have a thermoplastic liner 129 through which windings 127 extend. Also, windings 127 may be imbedded in a bonding material, such as epoxy 131, which is injected into liners 129 after windings 127 have been wound through slots 123.

Windings 127 extend continuously through slots 123 from the upper end to the lower end of stator 117. Windings 127 in one axial row of slots 123 pass from the lower end into another axial row in a selected pattern. A winding 127 for each phase extends from one end of stator 117, such as the upper end, for receiving AC current. When supplied with three phase AC power, windings 127 create electromagnetic fields directed inward toward axis 115.

Referring again to FIG. 3, central apertures 125 of stator and spacer discs 119, 121 have the same diameter, creating a cylindrical inward facing stator wall 133 of constant inner diameter. Stator wall 133 defines a central cylindrical stator cavity 134 that is coaxial with axis 115. A thin nonmagnetic container or can (not shown) optionally may enclose and seal stator 117, including its inner wall 133 and windings 127, to prevent well fluid in stator cavity 134 from contact with stator discs 119 and windings 127 (FIG. 4). Epoxy 131 (FIG. 4) in slots 123 seals windings 127 from contact with well fluid within central cavity 134 if a stator can is not employed.

Diffusers 135 are mounted in stator central cavity 134 for non rotation. In this embodiment, only the three lower diffusers 135 are shown. In practice, many more would be used. Each diffuser 135 is identical and may be made from a nonmagnetic material, such as Ni-Resist. Each diffuser 135 has a cylindrical exterior surface 137 that fits closely within stator wall 133. A diffuser seal 139 seals diffuser exterior surface 137 to stator wall 133. Each diffuser 135 has conventional diffuser passages 141 that lead from an intake area to an outlet area on the upper side. The diffuser passages 141 shown are of a mixed flow type that lead upward and inward. However, diffusers 135 could alternately be a radial flow type with passages 141 that lead primarily inward from the intake area to the outlet area.

In the embodiment shown, each diffuser 135 has a thin, lower end wall 143 that is cylindrical and secures by threads or other arrangement to a similar thin, upper end wall 145 of the next lower diffuser 35. Upward and downward thrust imposed on diffusers 135 passes axially between end walls 143, 145. Alternately, diffusers 135 could be axially spaced apart from each other and mechanisms other than anchor 57 (FIG. 1B) employed for anti-rotation and thrust transfer. To housing 113. In that alternative, magnets 143 could be placed closer to stator wall 133.

A rotatable impeller 147 mounts between each diffuser 135. Each impeller 147 can be made from a magnetic material, such as a type of a stainless steel. Alternately, they could be formed of a nonmagnetic material, such as Ni-Resist. Each impeller 147 has vanes 149 that spiral and extend from a central or common inlet 148 upward and outward to a discharge area on the upper periphery. The body of impeller 147 includes a curved outer wall 151 that joins vanes 149 on their outer edges. The body of impeller 147 also includes a curved inner wall 153 that joins the inner edges of vanes 149. Outer wall 151 and inner wall 153 extend circumferentially around axis 115. Vane passages 155 are defined between adjacent vanes 149 and between outer and inner walls 151, 153. Outer wall 151 closes the outer sides of vane passages 155 except at their inlets and outlets. Each vane passage 155 receives fluid from central inlet 148 and has a separate discharge on the upper end.

An array of permanent magnets 157 is mounted to and extends circumferentially around each impeller 147. Magnets 157 are not located in impeller passages 155 or on impeller vanes 149 in this embodiment. Rather, the array of magnets 157 is at a different radial distance from axis 115 than impeller passages 155 and impeller vanes 149. In this example, the array of magnets 157 is radially farther from axis 115 than impeller passages 155. In this example, each magnet 157 is bonded into a pocket 158 formed on the lower side of impeller outer wall 151. A thin, retaining wall 159 surrounds the array of magnets 157, separating magnets 157 from the inner surfaces of diffuser end walls 143, 145. Retaining wall 159 may be integral with the body of impeller 147 or a separate component attached to the body of impeller 147.

In this example, the upper ends of magnets 157 are at an elevation below the outlets of impeller passages 155. The lower ends of magnets 157 are shown above the lower end of impeller inlet 148. Magnets 158 thus may be shorter in axial length or dimension than the axial distance from inlet 148 of impeller 147 to the outlets of impeller passages 155. As shown in FIG. 5, magnets 157 are circumferentially spaced apart from each other.

Alternately, magnets 157 could have lengths much greater than the axial distance from inlet 148 of impeller 147 to the outlets of impeller passages 155. For example, if diffuser upper and lower end walls 145, 143 of adjacent diffusers 135 were axially separated from each other rather than connected, magnets 157 with much longer lengths could be mounted to the outer wall of impeller 147 in the axial space between diffusers 135. If so, the electromagnetic fields would not have to pass through abutting end walls 143, 145. Also, in that instance, thrust could be transferred between diffusers 135 by axial, nonrotating shafts.

Stator discs 119 are arranged to be radially outward from magnets 157 but not from diffusers 135. The axial length of each section of stator discs 119 is equal or greater than the axial length of magnets 157 so as to place magnets 157 in the electromagnetic fields. In this example, the lower end of each section of stator discs 119 is shown slightly above the lower ends of magnets 157 of one of the impellers 147, but they could be equal. The upper end of each section of stator discs 119 is shown to be slightly above the upper ends of magnets 157 of one of the impellers 147, but they could be equal.

Each section of spacer discs 121 is positioned to be radially outward from a large portion of the axial dimension of one of the diffusers 135, but not from magnets 157. Because the axial dimension of each diffuser 135 is greater than the axial dimension of magnets 157 in this embodiment, the axial length of each section of spacer discs 121 is greater than the axial length of each section of stator discs 119. The outer sides of magnets 157 are spaced radially from stator cavity wall 133 by an air gap plus the thickness of diffuser end walls 143, 145 in this embodiment.

As another alternative, magnets 157 could be mounted to impeller 147 in a circular array radially inward from impeller passages 155. In that instance, stator 117 would be mounted radially inward from the magnets 157 in a cylindrical column on the axis. Each impeller 157 would thus surround stator 117 and have a central opening through which stator 117 passes.

Referring again to FIG. 3, in this embodiment, each impeller 147 is rotationally locked to the other impellers 147 for rotation in unison. A shaft 161 extends coaxially through a diffuser bore 165 in each diffuser 135. Each impeller 147 has a hub 163 with an impeller bore 167 through which shaft 161 also extends. Shaft 161 is not driven by a separate motor, rather the rotation of impellers 147 in response to the interaction of magnets 157 and stator 117 causes shaft 161 to rotate. Impellers 147 are rotationally locked to shaft 161 by a suitable mechanism, such as a slot and key 169 arrangement, schematically shown. Impellers 147 may be free to slide short distances relative to shaft 161 in axial directions. Spacer tubes or bearing sleeves 168 may be located in diffuser bores 165 between hubs 163 of adjacent impellers 147.

Each impeller 147 has a skirt 171, which is a cylindrical, coaxial wall on its lower end. The inner diameter of skirt 171 defines impeller inlet 148. The outer diameter of skirt 171 fits within a diffuser skirt wall 173 on the upper side of the next lower diffuser 135. Skirt 171 closely slides in rotational engagement with diffuser skirt wall 173. A down thrust washer 175 may be located between a lower portion of impeller 147 outside of skirt 171 for engaging a mating surface on the next lower diffuser 135.

A cylindrical balance ring 177 protrudes from an upper side of each impeller 147. The next upward diffuser 135 has a cylindrical balance ring wall 179 depending downward. Balance ring wall 179 defines an annular balance ring cavity 181 on a lower side of diffuser 135. Balance ring 177 may closely slide in rotational engagement with the inner side of balance ring wall 179 of the next upward diffuser 135. An optional balance hole 183 leads from each impeller passage 155 upward to balance ring cavity 181 of the next upward diffuser 135. Balance holes 183 divert a portion of the upward flowing well fluid in impeller passages 155 to balance ring cavity 181. Some leakage of fluid in balance ring cavity 181 between balance ring 177 and balance ring wall 179 occurs, causing well fluid in balance ring cavity 181 to bleed back into the well fluid being discharged through impeller passages 155.

An upward thrust washer 184 may surround hub 163 for engaging a downward facing surface in the next upward diffuser 135. Thrust washer 184 transfers any up thrust imposed on impeller 147 to the next upward diffuser 135. Balance holes 183 reduce the extent of up thrust.

A nonrotating intake member 185 is illustrated on the lower side of the lowest impeller 147. Intake member 185 has features similar to the upper end portions of diffusers 135. The lowest impeller 147 slides within a receptacle in intake member 185 in the same manner as diffusers 135. Intake member 185 has a thin, upper outer wall 186 secured to the lower end wall 143 of the next upward diffuser 135. Down thrust on diffusers 135 passes to intake member 185 and from there through structure (not shown) to housing 113. Thrust bearings (not shown) may also be located at the upper or lower end of shaft 161 to absorb thrust on shaft 161.

While a few embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A well pumping assembly, comprising:

a housing having a longitudinal axis, the housing adapted to be secured to a string of production conduit in a well;

a stator mounted in the housing, the stator having an axially extending stator cavity, the stator having windings that when powered create an electromagnetic field into the stator cavity;

a pump having a landed position within the stator cavity, the pump having a non-rotating pump portion and a rotating pump portion;

magnets mounted on the rotating pump portion that impart rotation to the rotating pump portion in response to the electromagnetic field; and a neck on an upper end of the pump having a running and retrieval feature for engagement by a running and retrieving tool lowered through the production conduit to retrieve the pump through the production conduit from the housing and the stator while the housing and the stator remain secured to the production conduit.

2. The assembly according to claim 1, wherein the pump comprises a centrifugal pump.

3. The assembly according to claim 1, wherein the pump comprises a progressing cavity pump.

4. The assembly according to claim 1, wherein;

the stator will accept the pump when the pump is a centrifugal pump and also when the pump is a progressing cavity pump.

5. The assembly according to claim 1, wherein:

the non-rotating portion of the pump comprises a plurality of diffusers;

the rotating portion of the pump comprises an impeller rotatably mounted between each of the diffusers;

each of the magnets is mounted to one of the impellers; and the impellers are rotationally locked to each other for rotation in unison.

6. The assembly according to claim 1, wherein;

the non-rotating portion of the pump comprises a stack of diffusers;

the rotating portion of the pump comprises an impeller rotatably mounted between each of the diffusers;

each of the magnets is mounted to one of the impellers; the assembly further comprising:

a support member mounted in the lower end of the housing, the support member having a receptacle;

an anchor secured to and protruding from a lower end of the stack of diffusers, the anchor being received within the receptacle when the pump is in the landed position;

mating torque surfaces between the anchor and the receptacle, preventing rotation of the anchor relative to the receptacle; and an intake passage extending through the support member and the anchor to the diffusers.

7. The assembly according to claim 1, wherein;

the rotating portion of the pump comprises a tube having a progressing cavity passage, the magnets being mounted to the tube;

the non-rotating portion of the pump comprises a shaft within the progressing cavity passage, the shaft having a progressing cavity exterior;

a support member mounted in the lower end of the housing, the support member having a receptacle;

an intake chamber in the housing between the support member and the stator;

a progressing cavity pump flex shaft secured to and protruding from a lower end of the rotor through the intake chamber;

an anchor member at a lower end of the flex shaft, the anchor member being received within the receptacle while the pump is in the landed position;

mating torque surfaces between the anchor member and the receptacle, preventing rotation of the anchor member relative to the receptacle; and an intake passage extending through the anchor member to the intake chamber while the pump is in the landed position.

8. A well pumping assembly, comprising:

a housing having a longitudinal axis;

a stator mounted in the housing, the stator having an axially extending stator cavity, the stator having windings that when powered create an electromagnetic field into the stator cavity;

a pump having a landed position within the stator cavity, the pump having a non-rotating pump portion and a rotating pump portion;

magnets mounted on the rotating pump portion that impart rotation to the rotating pump portion in response to the electromagnetic field;

a neck on an upper end of the pump having a running and retrieval feature for engagement by a running and retrieving tool to retrieve the pump from and install the pump in the landed position;

a support member mounted in a lower end of the housing, the support member having a receptacle;

an anchor secured to and protruding from a lower end of the pump that is received within the receptacle when the pump is in the landed position; and mating torque surfaces between the anchor and the receptacle, preventing rotation of the anchor relative to the receptacle.

9. A well pumping assembly, comprising:

a housing having a longitudinal axis;

a stator mounted in the housing, the stator having an axially extending stator cavity, the stator having windings that when powered create an electromagnetic field into the stator cavity;

a pump having a landed position within the stator cavity, the pump having a non-rotating pump portion and a rotating pump portion;

magnets mounted on the rotating pump portion that impart rotation to the rotating pump portion in response to the electromagnetic field;

a neck on an upper end of the pump having a running and retrieval feature for engagement by a running and retrieving tool to retrieve the pump from and install the pump in the landed position;

a head secured to the upper end of the housing, the head having a bore in axial alignment with the stator cavity; wherein the neck extends sealingly through the bore while the pump is in the landed position; and the running and retrieval feature is above of the bore while the pump is in the landed position.

10. A well pumping assembly, comprising:

a housing having a longitudinal axis;

a stator mounted in the housing, the stator having an axially extending stator cavity, the stator having windings that when powered create an electromagnetic field into the stator cavity;

a pump having a landed position within the stator cavity, the pump having a non-rotating pump portion and a rotating pump portion;

magnets mounted on the rotating pump portion that impart rotation to the rotating pump portion in response to the electromagnetic field;

a neck on an upper end of the pump having a running and retrieval feature for engagement by a running and retrieving tool to retrieve the pump from and install the pump in the landed position;

the rotating portion of the pump comprises a tube having a progressing cavity passage; and the non-rotating portion of the pump comprises a shaft within the progressing cavity passage, the shaft having a progressing cavity exterior.

11. A method of pumping well fluid from a well, comprising:

providing a housing having a longitudinal axis, the housing having a stator with an axially extending stator cavity and windings;

placing in the stator cavity a first pump having a non-rotating pump portion and a rotating pump portion, the first pump having magnets on the rotating pump portion;

securing the housing to a production conduit and installing the production conduit and the housing containing the first pump in a well;

supplying power to the stator, creating an electromagnetic field that imparts rotation to the rotating pump portion in response to the electromagnetic field, causing well fluid to flow through the first pump and up the production conduit; then lowering a retrieving string into the well through the production conduit, engaging the first pump, and retrieving the first pump from the stator cavity while the housing and the stator cavity remain secured to the production conduit.

12. The method according to claim 11, further comprising:

after retrieving the first pump, attaching a running string to a second pump, then lowering the running string into the well through the production conduit and landing the second pump in the stator cavity; then supplying power again to the stator, creating an electromagnetic field that imparts rotation to a rotating pump portion of the second pump in response to the electromagnetic field, causing well fluid to flow through the second pump and up the production conduit.

13. The method according to claim 12, wherein one of the first and second pumps comprises a centrifugal pump and the other of the first and second pumps comprises a progressing cavity pump.

14. The method according to claim 11, wherein:

the first pump comprises a progressing cavity pump;

the rotating portion of the progressing cavity pump comprises a tube having a progressing cavity passage; and the non-rotating portion of the progressing cavity pump comprises a shaft within the progressing cavity passage, the shaft having a progressing cavity exterior.

15. A well pumping assembly, comprising:

a housing having a longitudinal axis;

a stator mounted in the housing, the stator having an axially extending stator cavity, the stator having windings that when powered create an electromagnetic field in the stator cavity;

a progressing cavity pump within the stator cavity, the pump having a non-rotating pump portion and a rotating pump portion;

magnets mounted on the rotating pump portion that impart rotation to the rotating pump portion in response to the electromagnetic field;

a support member mounted in a lower end of the housing, the support member having a receptacle;

an anchor member on an end of the non-rotating portion of the pump, the anchor member being received within the receptacle while the pump is in a landed position; and mating torque surfaces between the anchor member and the receptacle, preventing rotation of the anchor member relative to the receptacle.

16. The assembly according to claim 15, further comprising:

an intake chamber in the housing between the support member and the stator;

a progressing cavity pump flex shaft defining the end of the non-rotating pump portion and protruding through the intake chamber;

wherein the anchor member is on an end of the flex shaft; and an intake passage extending through the anchor member to the intake chamber while the pump is in the landed position.

17. A well pumping assembly, comprising:

a housing having a longitudinal axis;

a stator mounted in the housing, the stator having an axially extending stator cavity, the stator having windings that when powered create an electromagnetic field in the stator cavity;

a progressing cavity pump within the stator cavity, the pump having a non-rotating pump portion and a rotating pump portion;

magnets mounted on the rotating pump portion that impart rotation to the rotating pump portion in response to the electromagnetic field; wherein:

the rotating portion of the pump comprises a tube having a progressing cavity passage; and the non-rotating portion of the pump comprises a shaft within the progressing cavity passage and having a progressing cavity exterior.

18. The assembly according to claim 17, further comprising:

a head on an upper end of the housing, the head having an axial passage coaxial with the stator cavity and having a diameter at least equal to an inner diameter of the stator cavity;

a neck extending from the non-rotating portion of the pump through the axial passage; and a running and retrieving feature on the neck for receiving a running and retrieving string to run and retrieve the pump from the stator cavity through the axial passage.

19. The assembly according to claim 17, further comprising:

a head on an upper end of the housing, the head having an axial passage coinciding with the stator cavity;

a set of threads on the head for securing the head and the housing to a string of production tubing; and a sleeve surrounding the tube, the tube being bonded to the sleeve, the sleeve having a neck extending sealingly through the axial passage, the neck having a flow passage for well fluid pumped by the pump to flow through.

* * * * *